US006935898B2

(12) United States Patent
Lai

(10) Patent No.: US 6,935,898 B2
(45) Date of Patent: Aug. 30, 2005

(54) CARD CONNECTOR

(75) Inventor: Yaw-Huey Lai, Taipei Hsien (TW)

(73) Assignee: Tai-Sol Electronics Co., Ltd., Taipei Hsien (TW)

( * ) Notice: Subject to any disclaimer, the term of this patent is extended or adjusted under 35 U.S.C. 154(b) by 0 days.

(21) Appl. No.: 10/749,566

(22) Filed: Jan. 2, 2004

(65) Prior Publication Data

US 2005/0095916 A1 May 5, 2005

(30) Foreign Application Priority Data

Nov. 3, 2003 (TW) ..... 92219544 U

(51) Int. Cl.[7] ..... H01R 24/00
(52) U.S. Cl. ..... 439/630
(58) Field of Search ..... 439/630, 188, 439/489, 159, 325, 160, 327, 328

(56) References Cited

U.S. PATENT DOCUMENTS 6,129,588 A * 10/2000 Chang ..... 439/630
6,244,902 B1 * 6/2001 McDowell et al. ..... 439/630
6,247,947 B1 * 6/2001 Knoernschild et al. ..... 439/159
6,419,509 B2 * 7/2002 Cho ..... 439/159
6,478,592 B1 * 11/2002 Hu et al. ..... 439/159

* cited by examiner

*Primary Examiner*—Ross Gushi
(74) *Attorney, Agent, or Firm*—Bacon & Thomas, PLLC

(57) ABSTRACT

An improved card connector is composed of a base having a receiving space at a midsection thereof, an insertion slot at a front end thereof for inserting a memory card inside, and two guide sections recessed therefrom respectively at two sides of the receiving space; a cover member mounted on the base; a plurality of terminals disposed on the base and extend into the receiving space; at least one resilient contact member mounted at a side of the base; and a lateral biasing member mounted at the other side of the base to face the resilient contact member and has a part extending into the receiving space. Accordingly, the inserted memory card can be pushed to touch the resilient contact member to enable the resilient contact member of the card connector to certainly detect the write protection of the memory card.

3 Claims, 11 Drawing Sheets

CARD CONNECTOR

BACKGROUND OF THE INVENTION

1. Field of the Invention

The present invention relates generally to electronic devices, and more particularly to a card connector that has a lateral biasing member and can certainly detect whether the write protection of an inserted memory card is active or inactive.

2. Description of the Related Art

A conventional card connector includes resilient contact members inside for touching a write-protection contact of an inserted memory card to detect whether the write protection of the memory card is active or not. Because each of the card connectors is manufactured in a predetermined size, the receiving space inside each of the card connectors has a predetermined standard size for inserting a memory card of the predetermined standard size.

As shown in FIG. 10, when a memory card 98 of a predetermined standard size is inserted into a conventional card connector 91, the write-protection contact of the memory card 98 can certainly function with the resilient contact members 95 to generate an accurate detection. However, some commercially available memory cards are slightly smaller than the standard size on grounds of the inaccuracy during the manufacturing process. As shown in FIG. 11, when another smaller memory card 99 is inserted into the card connector 91, the write-protect contact of the memory card 99 may probably fail to touch and function with the resilient contact member 95 to incur error action. In the meantime, it will be erroneously detected that the write protection of the memory card 99 is active to prevent the memory card 99 from write-in to further incur negative influence on the accuracy of the data storage.

SUMMARY OF THE INVENTION

The primary objective of the present invention is to provide an improved card connector that has a lateral biasing member for resiliently pushing a memory card to touch a resilient contact member of the card connector to enable the write protection of the memory card to be detected to avoid error action.

The foregoing objective of the present invention is attained by the improved card connector that is composed of a base, a cover member, a plurality of terminals, at least one resilient contact member, and a lateral biasing member. The base includes a receiving space at a midsection thereof, an insertion slot at a front end thereof for inserting a memory card inside, and two guide sections recessed therefrom respectively at two sides of the receiving space. The cover member is mounted on the base. The terminals are disposed on the base and extend into the receiving space. The resilient contact member is mounted at a side of the base. The lateral biasing member is mounted at the other side of the base to face the resilient contact member and has a part extending into the receiving space. Accordingly, the inserted memory card can be pushed to touch the resilient contact member to enable the resilient contact member of the card connector to certainly detect the write protection of the memory card.

DETAILED DESCRIPTION OF THE INVENTION

Figure 1:
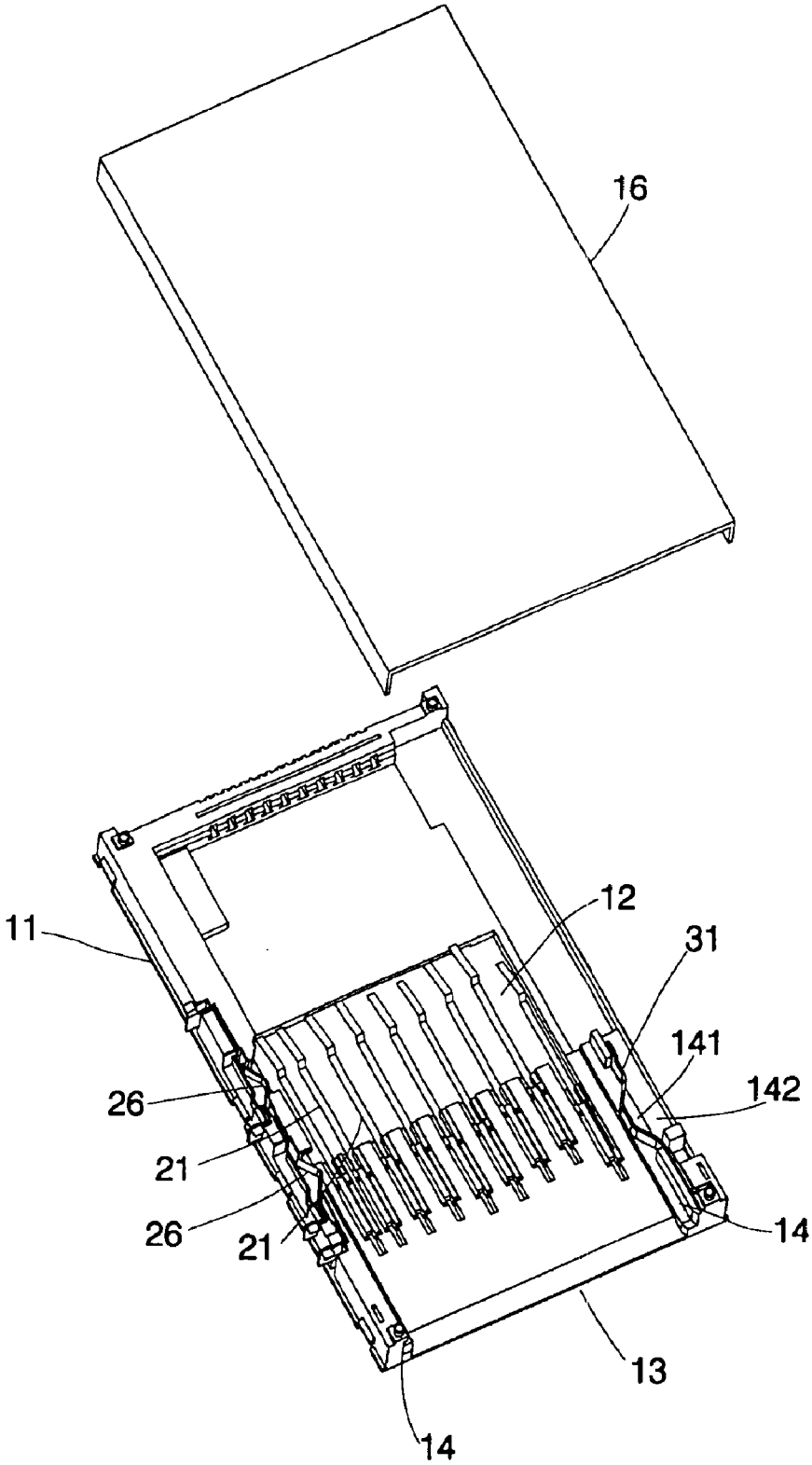
FIG. 1 is a partially exploded view of a first preferred embodiment of the present invention.
Figure 2:
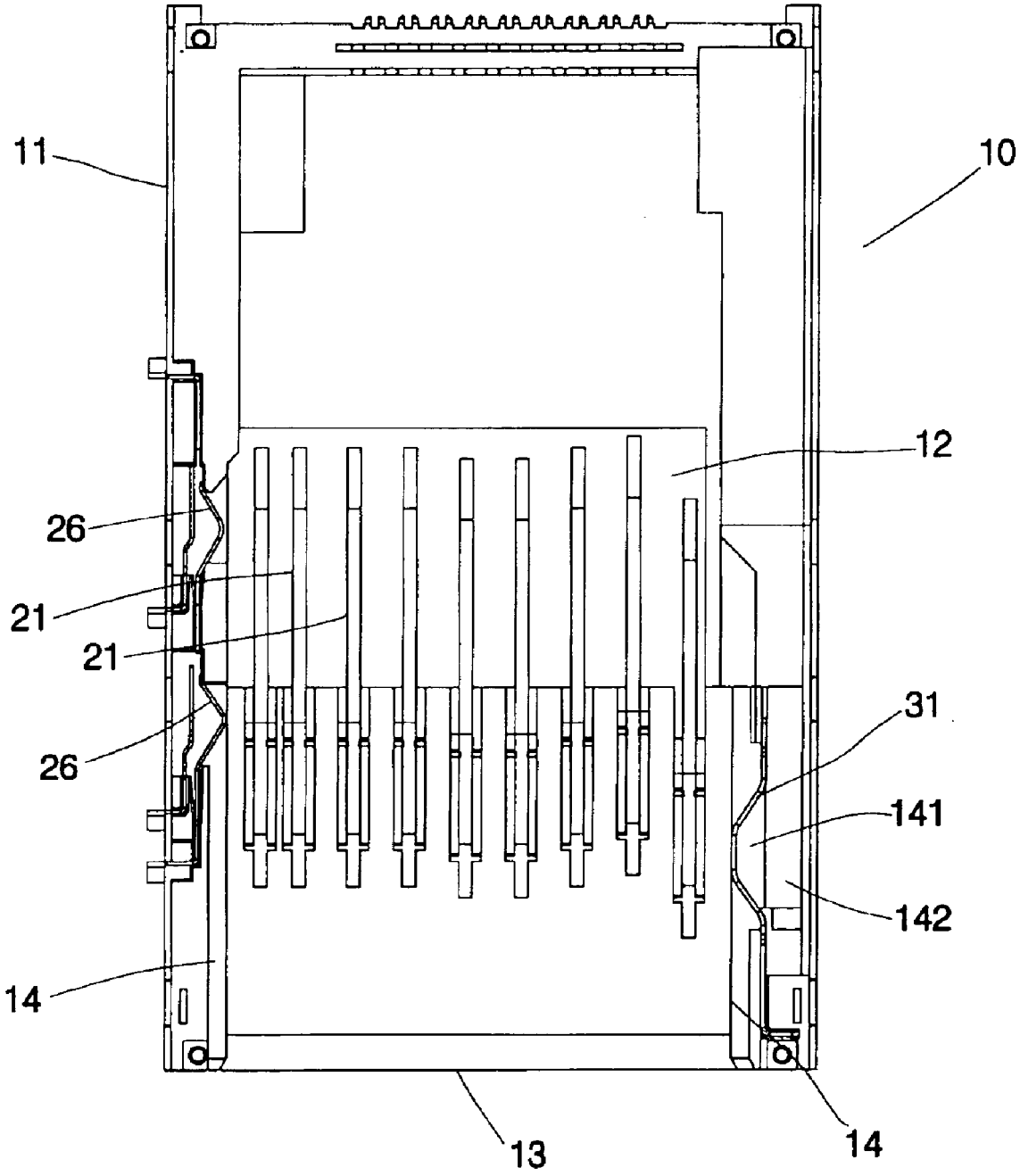
FIG. 2 is a top view of the first preferred embodiment of the present invention with a cover member removed.

Referring to FIGS. 1–2, a card connector 10 constructed according to a first preferred embodiment of the present invention is composed of a base 11, a cover member 16, a plurality of terminals 21, two resilient contact members 26, and a lateral biasing member 31.

The base 11 includes a receiving space 12 at a midsection thereof, an insertion slot 13 at a front end thereof for inserting a memory card inside, and two guide sections 14 recessed at two sides of the receiving space 12.

The cover member 16 is mounted on the base 11.

The terminals 21 are disposed on the base 11 and extend into the receiving space 12.

The two resilient contact members 26 are mounted on the base 11 and are positioned at a left side of the receiving space 12.

The lateral biasing member 31 is a metallic tongue and has at least one end inserted into the base 11, positioned beside the guide section 14 of the right side of the receiving space 12. The guide sections 14 has an opening 141 and an elongated chamber 142 recessed from the opening 141 towards the base 11 for accommodating the deformation of the lateral biasing member 31. The lateral biasing member 31 is received inside the chamber 142 and has an end inserted into the base 11, a body portion bended towards the opening 141 of the guide section 14 and extending into the receiving space 12, and the other end spaced apart from an edge of the chamber 142 for a predetermined distance.

Accordingly, when a memory card is inserted into the card connector 10, the memory card is pushed towards the resilient contact members 26 by the lateral biasing member 31 to enable the resilient contact members 26 to function well.

Figure 3:
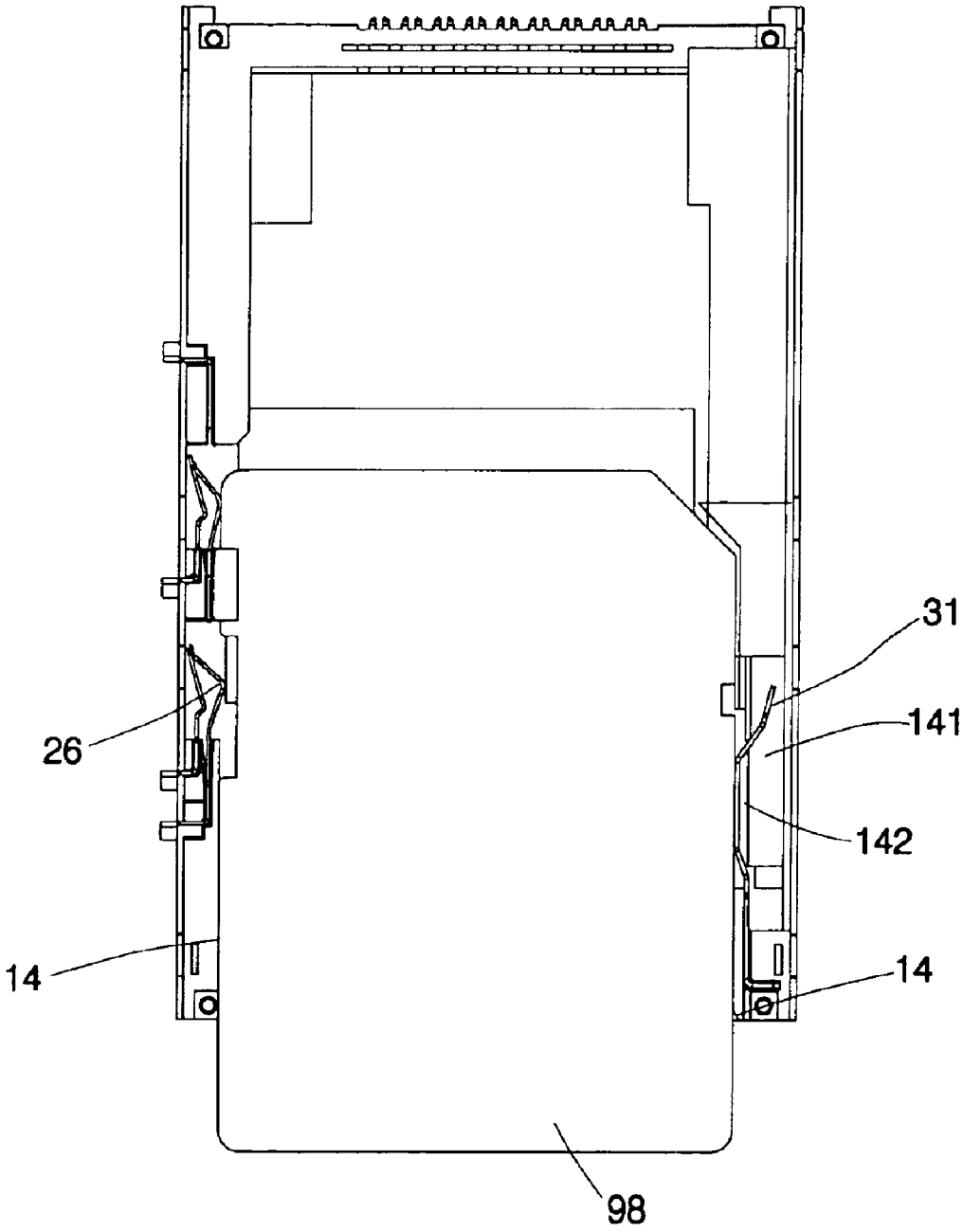
FIG. 3 is a schematic view of the first preferred embodiment of the present invention at work, showing that a memory card of a standard size is inserted into the present invention.

Referring to FIG. 3, when a memory card 98 of a standard size is inserted into the present invention of the first preferred embodiment, bilateral edges of the memory card 98 are fitted respectively into the two guide sections 14. During the insertion of the memory card 98, the lateral biasing member 31 is pushed to deform and to retract towards the chamber 142 and also provides a resilience to push the memory card 98 towards the resilient contact members 26; meanwhile, because the memory card 98 is in standard size, the lateral biasing member 31 approaches the resilient contact members 26 at a lateral edge thereof even without the lateral biasing member 31. Thus, the write-protection contact of the memory card 98 can certainly function with the resilient contact members 26.

Figure 4:
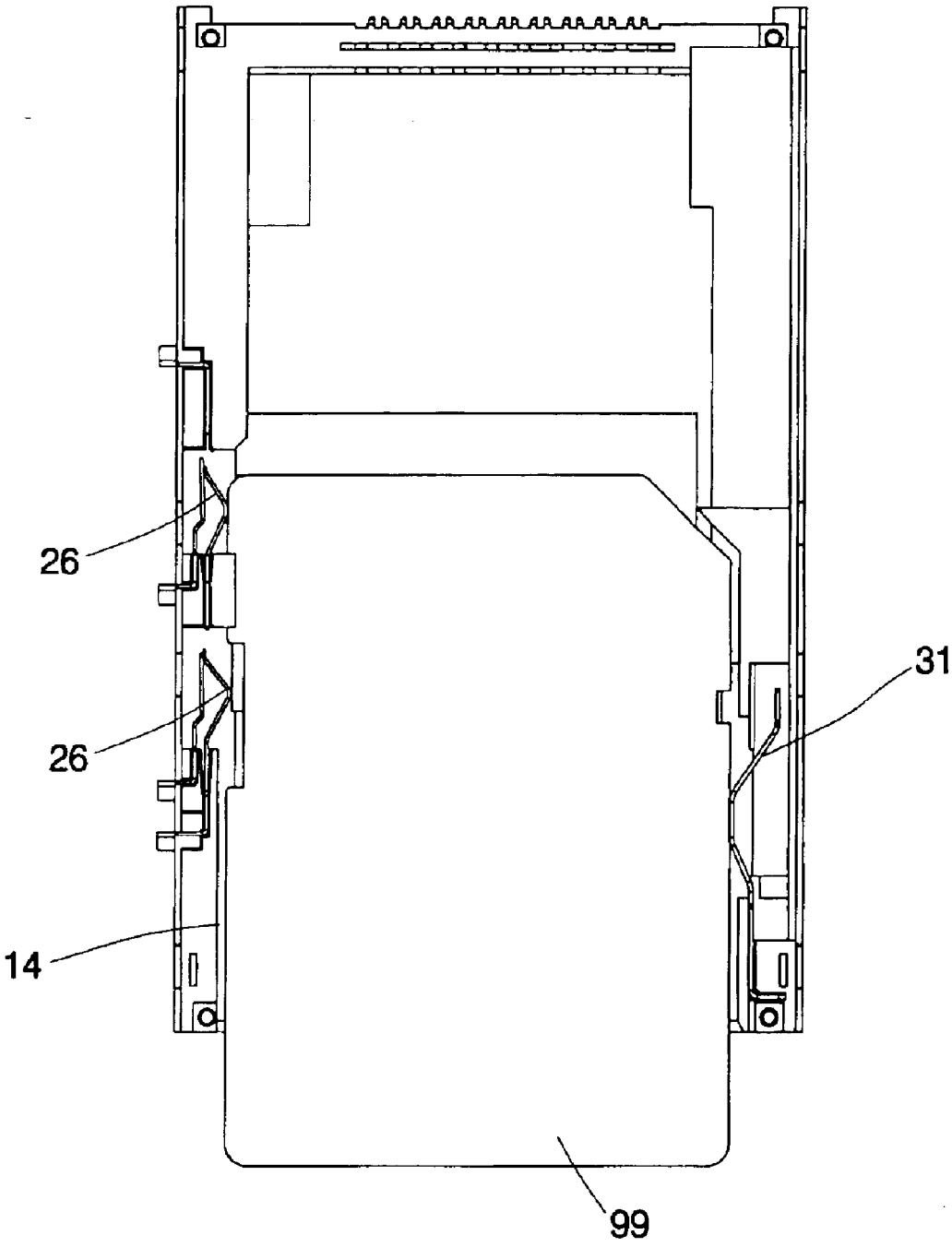
FIG. 4 similar to FIG. 3 shows that another memory card of a smaller size is inserted into the present invention.

Referring to FIG. 4, when another memory card 99 that has a smaller size due to the inaccuracy during the manufacturing process is inserted into the present invention of the first preferred embodiment, the memory card 99 pushes to deform the lateral biasing member 31 and is then pushed by the resilience to move towards the guide section 14 of the left side of the receiving space 12 to approach the write-protection contact of the memory card 99, such that the memory card 99 can be detected whether its write protection is active or not by the resilient contact members 26.

Figure 5:
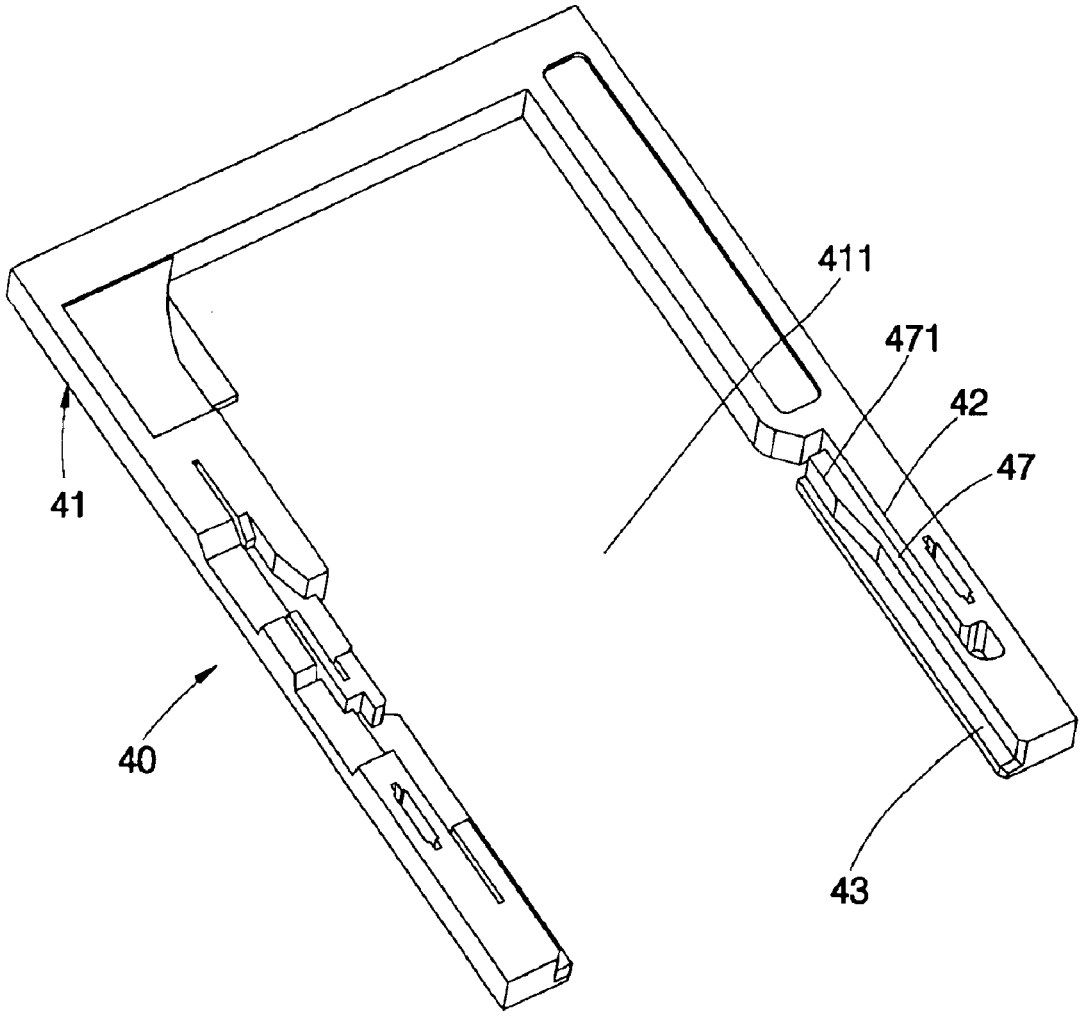
FIG. 5 is a perspective view of a base of a second preferred embodiment of the present invention.
Figure 6:
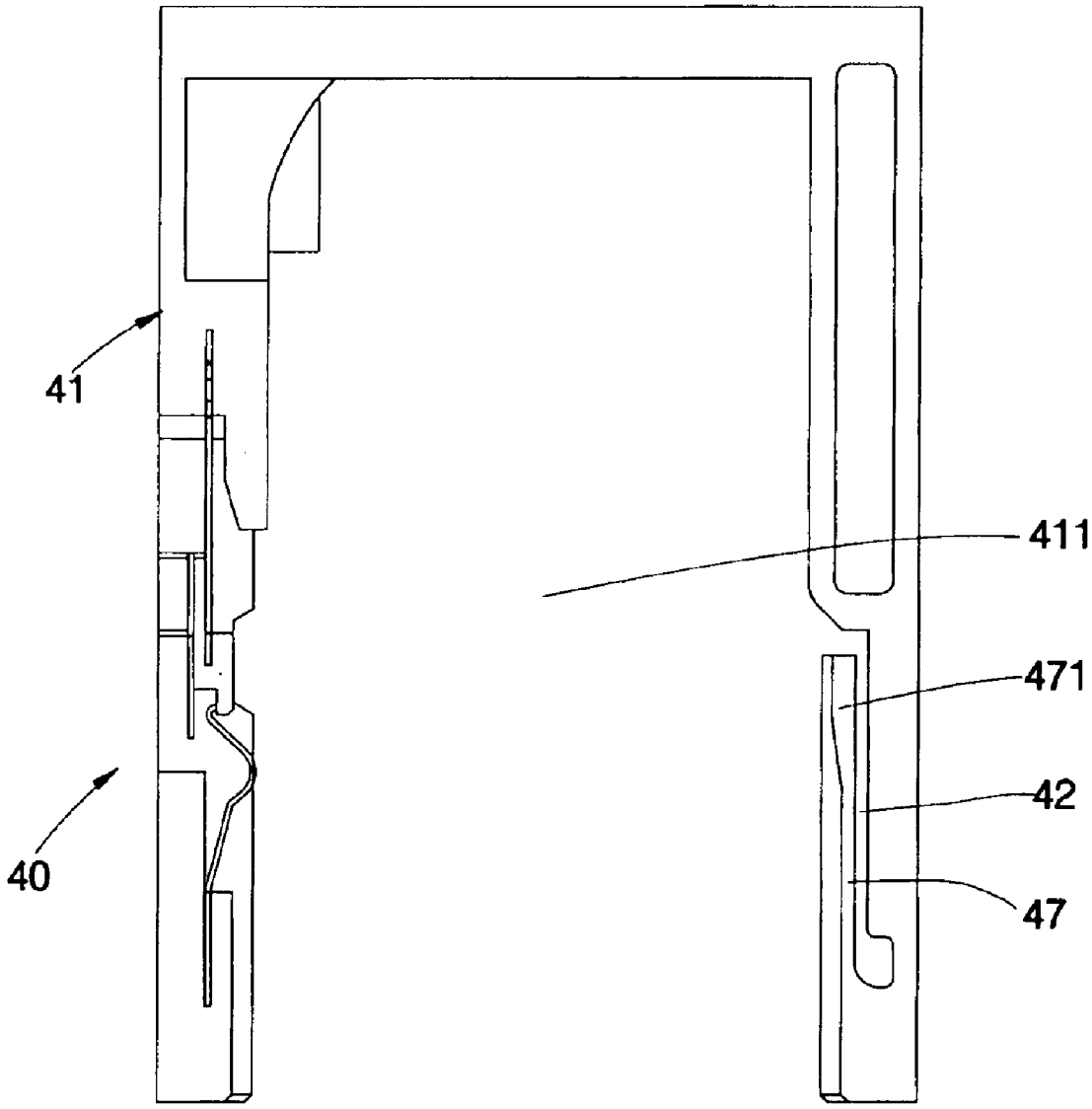
FIG. 6 is a top view of the base of the second preferred embodiment of the present invention.

Referring to FIGS. 5–6, a card connector 40 constructed according to a second preferred embodiment of the present invention is different from the first preferred embodiment only by that the lateral biasing member 47 extends and bends inwards from a right side of the base 41 to be integrally formed with the base 41, a gap 42 is formed between the lateral biasing member 47 and the base 4; the gap 42 is positioned beside the guide section 43 of the right side of the receiving space 12, and the guide section 43 is formed on the lateral biasing member 31. The lateral biasing member 47 has a projection 471 extending from the guide section 43 towards the receiving space 411 of the base 41 for a predetermined length.

Figure 7:
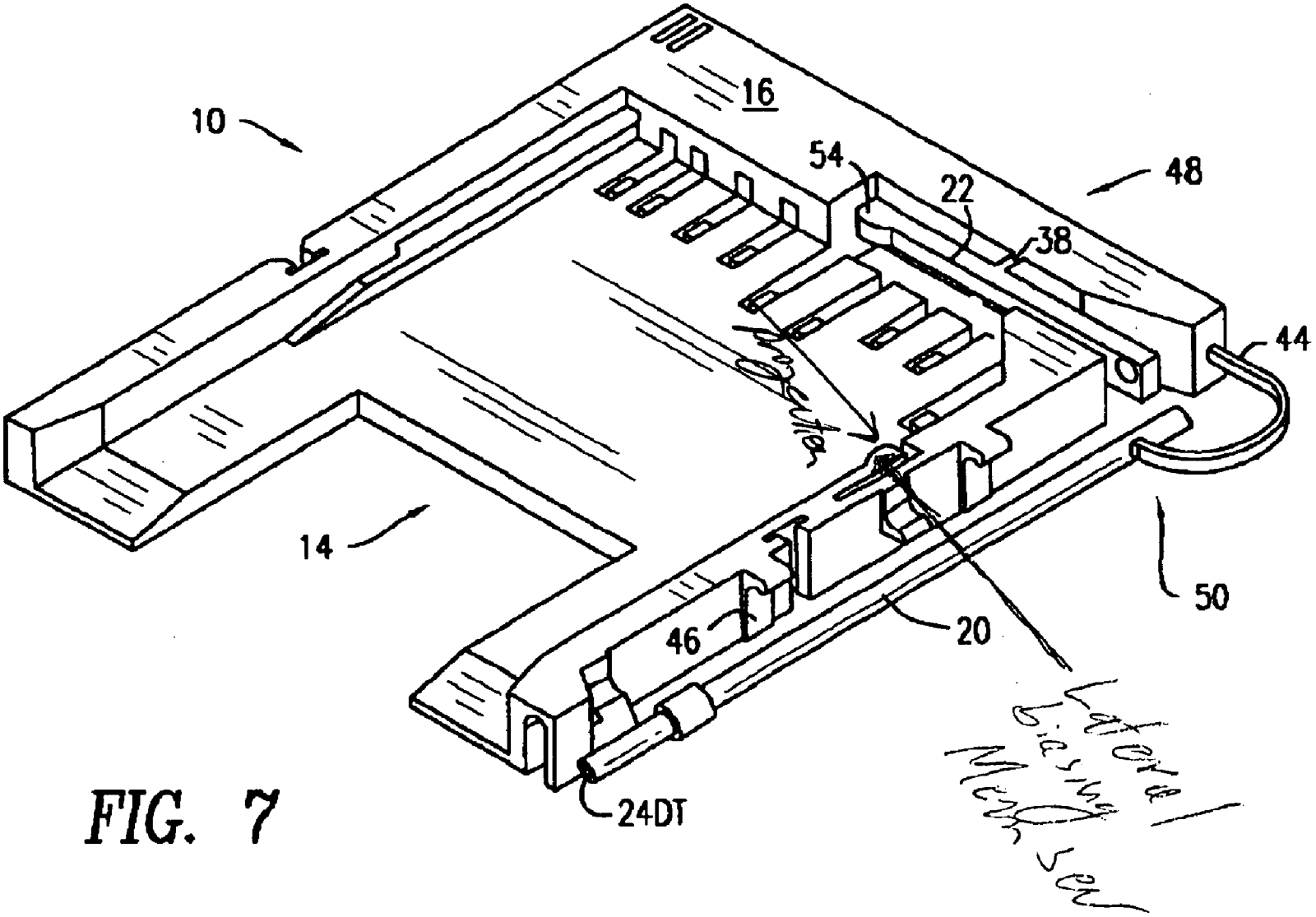
FIG. 7 is a schematic view of the second preferred embodiment of the present invention at work, showing that the memory card of the standard size is inserted into the present invention.
Figure 8:
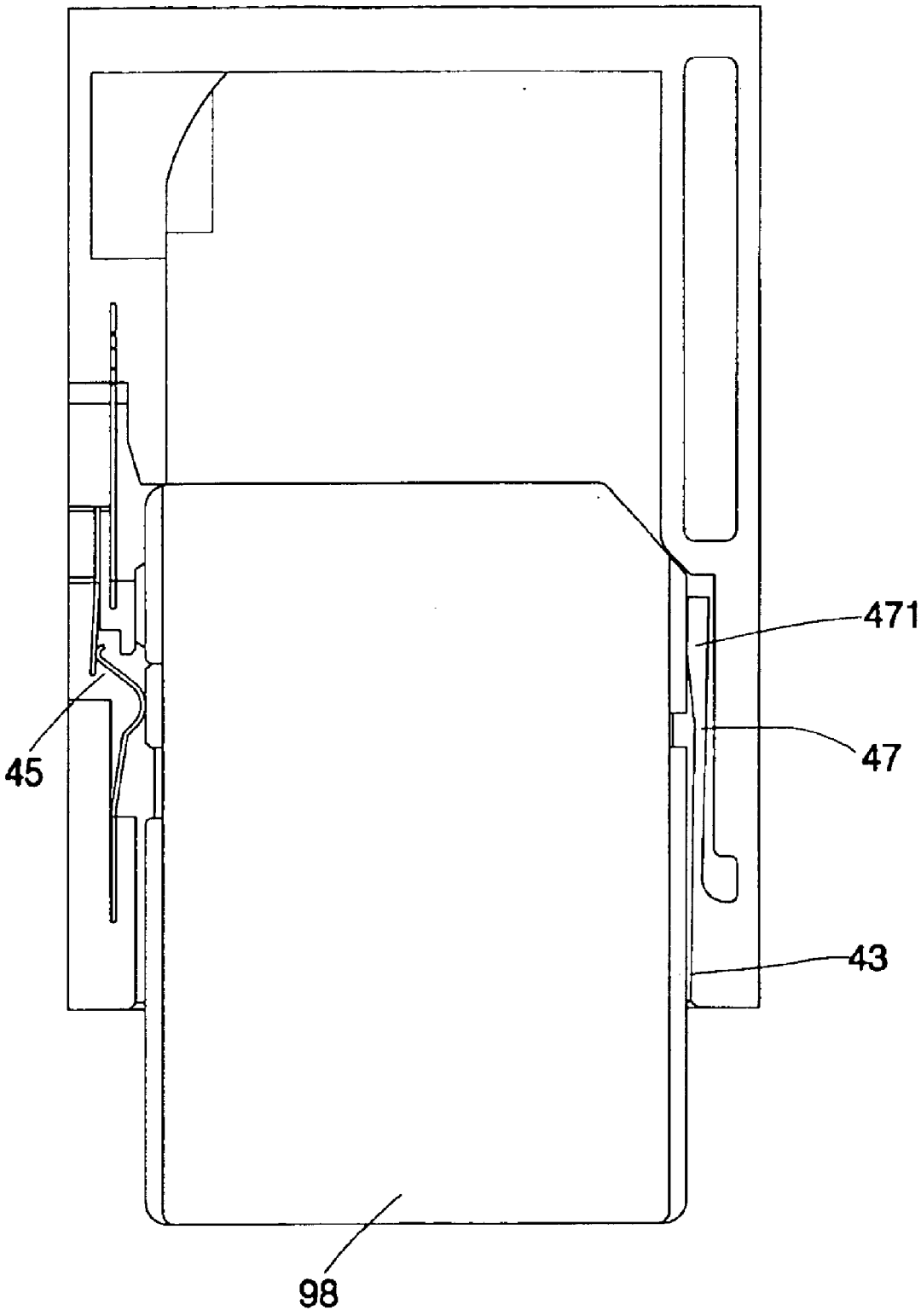
FIG. 8 similar to FIG. 7 shows that the memory card of the smaller size is inserted into the present invention.

Referring to FIGS. 7–8, when the memory card 98 of a standard size or the memory card 99 of a smaller size is inserted into the present invention of the second preferred embodiment, each of the memory cards 98 and 99 can be inserted along the guide sections 43 at the bilateral edges thereof and then into the card connector 40 to push the projection 471, further enabling the projection 471 to push the memory card 98 or 99 towards the left side of the receiving space 411 to approach the resilient contact members 45. Hence, the write-protection contact of the memory card 98 or 99 can certainly function with the resilient contact members 45 to detect whether the write protection of the memory card 98 or 99 is active or not and to incur no error action.

Figure 9:
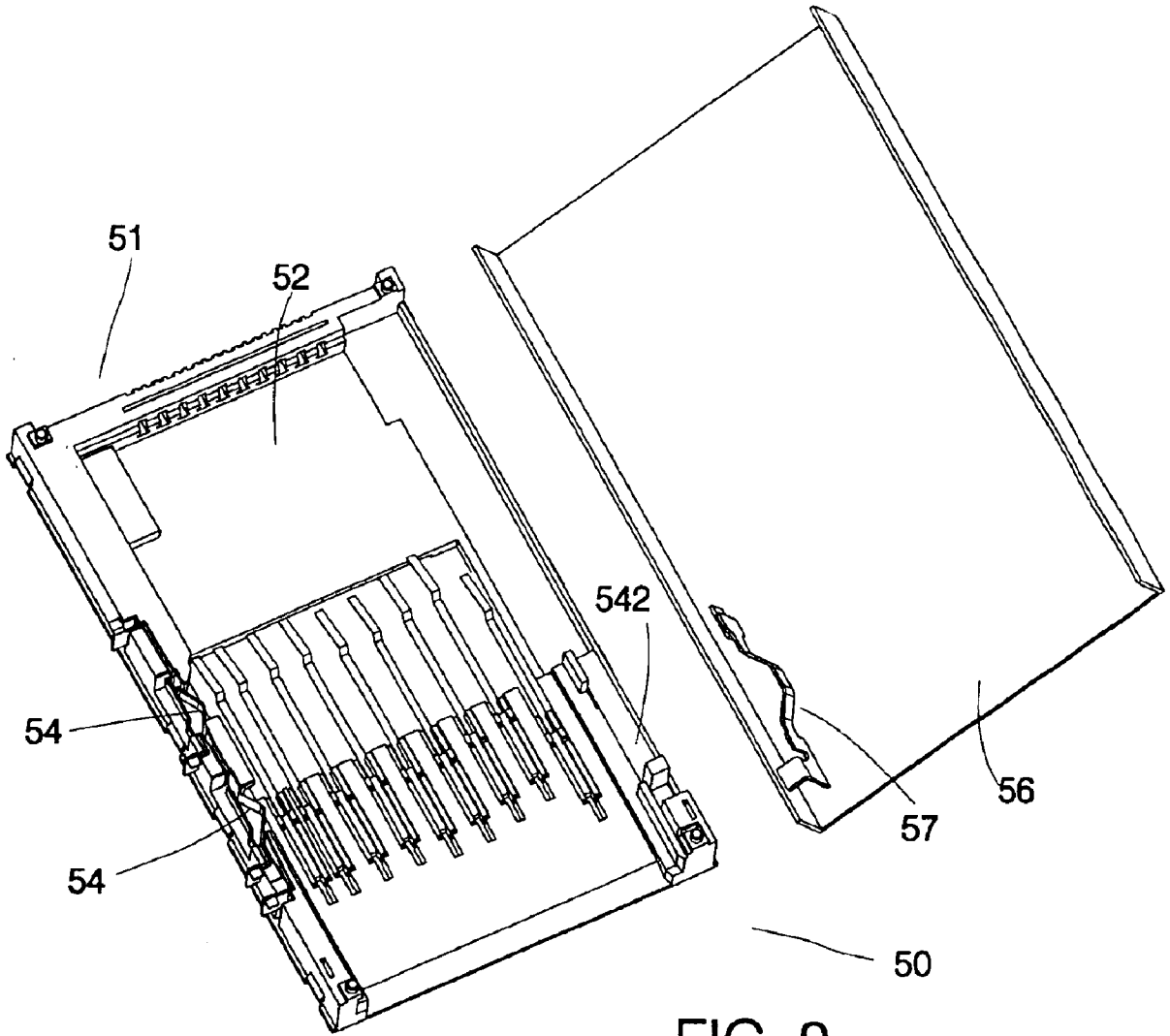
FIG. 9 is a partially exploded view of a third preferred embodiment of the present invention.
Figure 10:
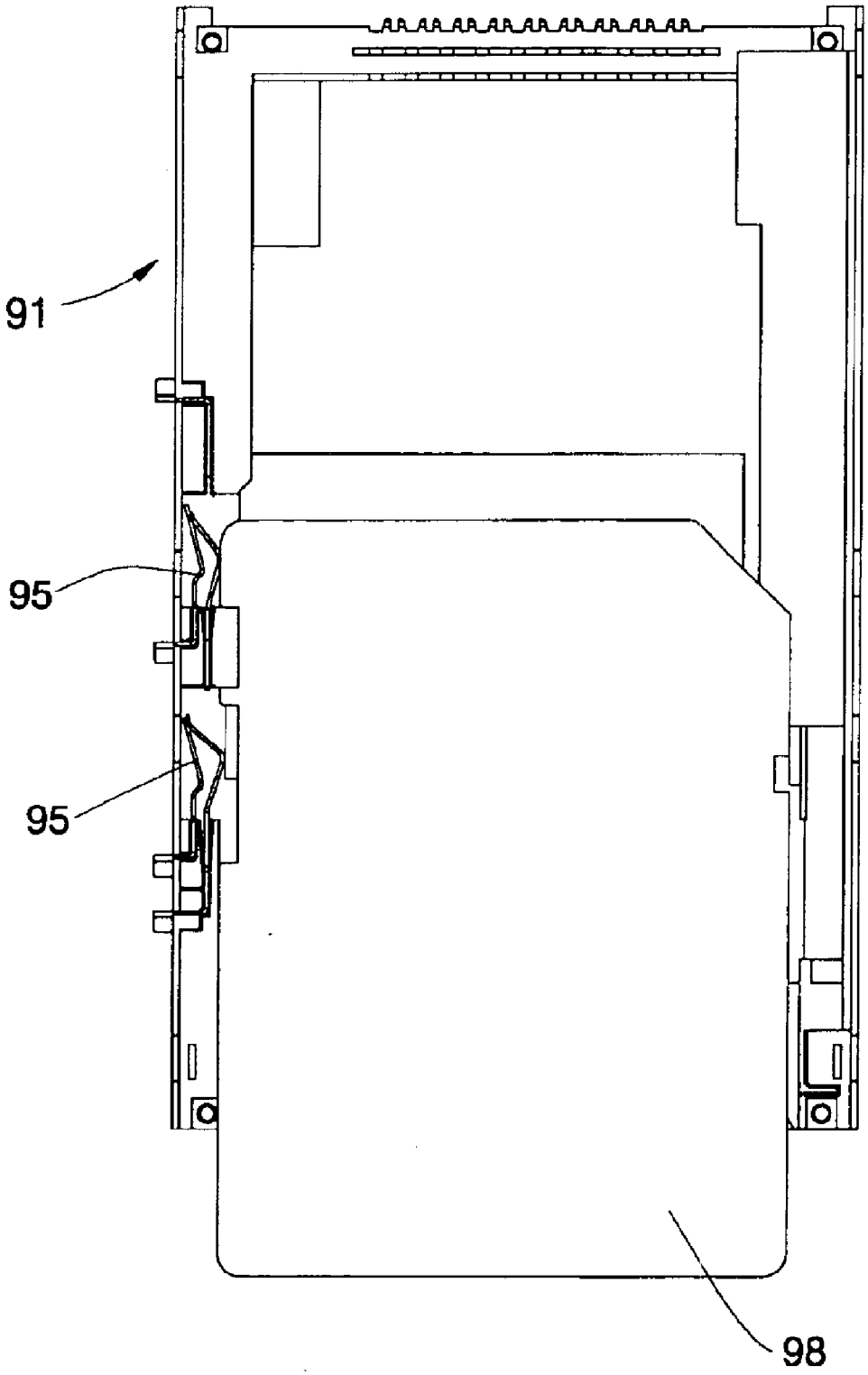
FIG. 10 PRIOR ART
FIG. 10 is a schematic view of a conventional card connector at work, showing that the memory card of the standard size is inserted into the card connector.
Figure 11:
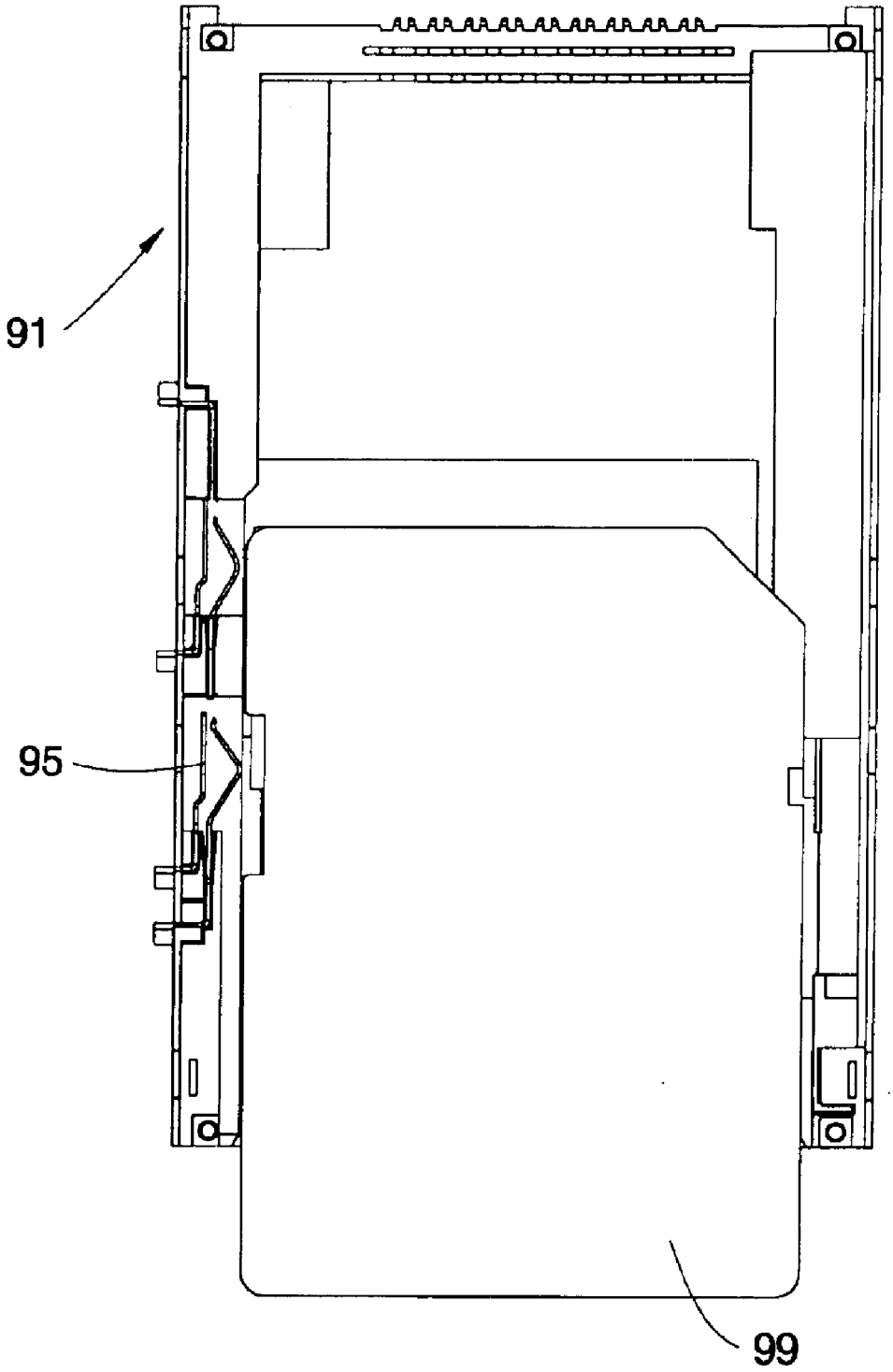
FIG. 11 PRIOR ART
FIG. 11 similar to FIG. 10 shows that the memory card of the smaller size is inserted into the card connector.

Referring to FIG. 9, the card connector 50 constructed according to a third preferred embodiment of the present invention is different from the first preferred embodiment only by that the lateral biasing member 57 has an end mounted at an underside of the cover member 56. When the cover member 56 is mounted on the base 51, the lateral biasing member 57 is positioned in the elongated chamber 542 at a side of the base 51 and faces the resilient contact members 54, having a part extending into the receiving space 52. Therefore, though the arrangement of the lateral biasing member 57 is different from those of the aforementioned preferred embodiments, the lateral biasing member 57 can still be located in the same position of the base 51 to attain the primary objective of the present invention.

In conclusion, when any of the memory cards is inserted into the present invention, the lateral biasing member can push the memory card toward a side of the base to approach the resilient contact members, such that the write-protection contact of the memory card can certainly function with the resilient contact members, thereby detecting whether the write protection of the memory card is active or not and incurring no error action.

What is claimed is:

1. A card connector comprising:

a base having a receiving space defined at a midsection thereof, an insertion slot formed at a front end thereof for inserting a memory card, and two guide sections formed at first and second lateral sides of said receiving space for receiving lateral edges of said memory card;

a cover member mounted on said base;

a plurality of terminals disposed on said base and extending into said receiving space;

at least one resilient contact member mounted at the first lateral side of said receiving space for contacting a write protection contact of said memory card; and a lateral biasing member mounted at the second side of said receiving space to face said resilient contact member and having a part extending into said receiving space for engaging one of the lateral edges of said memory card and pushing the memory card towards said at least one resilient contact member to ensure contact between said at least one resilient contact member and said write protection contact of said memory card when said memory card is completely inserted into said receiving space, wherein said lateral biasing member is a metallic tongue and has at least one end inserted into said base and a part positioned at one of said two guide sections and extending into said receiving space, and wherein said guide section corresponding to said lateral biasing member has an opening and an elongated chamber recessed from said opening towards said base, said lateral biasing member being positioned inside said chamber and having an end inserted into said base, a body portion being bent towards said opening of said guide section and extending into said receiving space, and the other end of said lateral biasing member being spaced apart from an edge of said chamber for a distance.

2. The card connector as defined in claim 1, wherein said lateral biasing member is integrally formed with said base so that base has a side opposite to said resilient contact members and bent inwards, and a gap is formed between said lateral biasing member and said base and is positioned beside said guide section at said side of said base, said guide section being positioned on said lateral biasing member.

3. The card connector as defined in claim 2, wherein said lateral biasing member further comprises a projection extending from said guide section towards said receiving space for a length.

* * * * *